US005458505A

United States Patent [19]

Prager

[11] Patent Number: 5,458,505

[45] Date of Patent: Oct. 17, 1995

[54] LAMP COOLING SYSTEM

[76] Inventor: Jay H. Prager, 12440 Addison, Valley Village, Calif. 91607

[21] Appl. No.: 190,841

[22] Filed: Feb. 3, 1994

[51] Int. Cl.[6] ..... H01R 13/00

[52] U.S. Cl. ..... 439/485; 361/695; 361/697

[58] Field of Search ..... 439/485, 487; 361/697, 695

[56] References Cited

U.S. PATENT DOCUMENTS

| | | | |
|---|---|---|---|
| 2,176,657 | 10/1939 | Finch | 439/485 |
| 4,780,799 | 10/1988 | Groh | 439/485 |
| 5,351,166 | 9/1994 | Kang | 361/697 |

FOREIGN PATENT DOCUMENTS

| | | | |
|---|---|---|---|
| 738273 | 10/1955 | United Kingdom | 361/695 |

*Primary Examiner*—P. Austin Bradley
*Assistant Examiner*—Jeffrey T. Knapp
*Attorney, Agent, or Firm*—Allen A. Dicke, Jr.

[57] ABSTRACT

Lamp cooler housing contains a lamp socket and a heat sink in association with an internal lamp socket. The heat sink carries fins thereon. A motor-driven fan in the housing moves air across the internal lamp socket and fins for their cooling. Electronics may be mounted in the housing for powering the fan motor and/or the lamp. The moving air also passes across these electronics for the cooling thereof.

24 Claims, 2 Drawing Sheets

LAMP COOLING SYSTEM

FIELD OF THE INVENTION

The lamp cooling system inserts into a standard socket and receives a lamp bulb. The lamp cooling system has a fan and cooling fins therein for cooling the lamp and electronics.

BACKGROUND OF THE INVENTION

Lamps generate heat and, in some cases, the heat limits lamp life. In other cases, the generated heat prevents utilization of a lamp of the required luminosity because overheating of the system occurs. Thus, the installation of lamp bulbs is often limited by the cooling capacity of the environment. In many cases, additional cooling is required in order to permit the utilization of a lamp of the desired luminosity.

SUMMARY OF THE INVENTION

In order to aid in the understanding of this invention, it can be stated in essentially summary form that it is directed to a lamp cooling system wherein the system includes a housing which has a lamp socket therein and which can be installed in a lighting system. The lamp is inserted into the lamp socket, and the housing contains fins to dissipate heat from the lamp socket and contains a motor-driven fan to move air over the lamp and fins. The housing may contain electronics for powering the fan motor and/or the lamp.

It is thus a purpose and advantage of this invention to provide a lamp cooling system which permits the installation of a high-power lamp bulb in a socket location which would not otherwise permit it due to lack of adequate cooling.

It is another purpose and advantage of this invention to provide a lamp cooling system wherein high-power lamps can be employed to permit illumination at a higher level than would be permitted if ordinary cooling were to be relied upon.

It is another purpose and advantage of this invention to provide lamp cooling systems one of which can utilize a standard screw-in bulb base, while another one permits the insertion of a lamp having a plug-in base, both of which systems have forced cooling of the lamps.

It is another purpose and advantage of this invention to provide lamp cooling systems which can be employed in an ordinary retrofit by screwing it into a standard threaded socket, and yet permit a lamp of higher luminosity because its base is force-cooled.

Other purposes and advantages of this invention will become apparent from a study of the following portion of the specification, the claims and the attached drawings.

DESCRIPTION OF THE PREFERRED EMBODIMENTS

Figure 2:
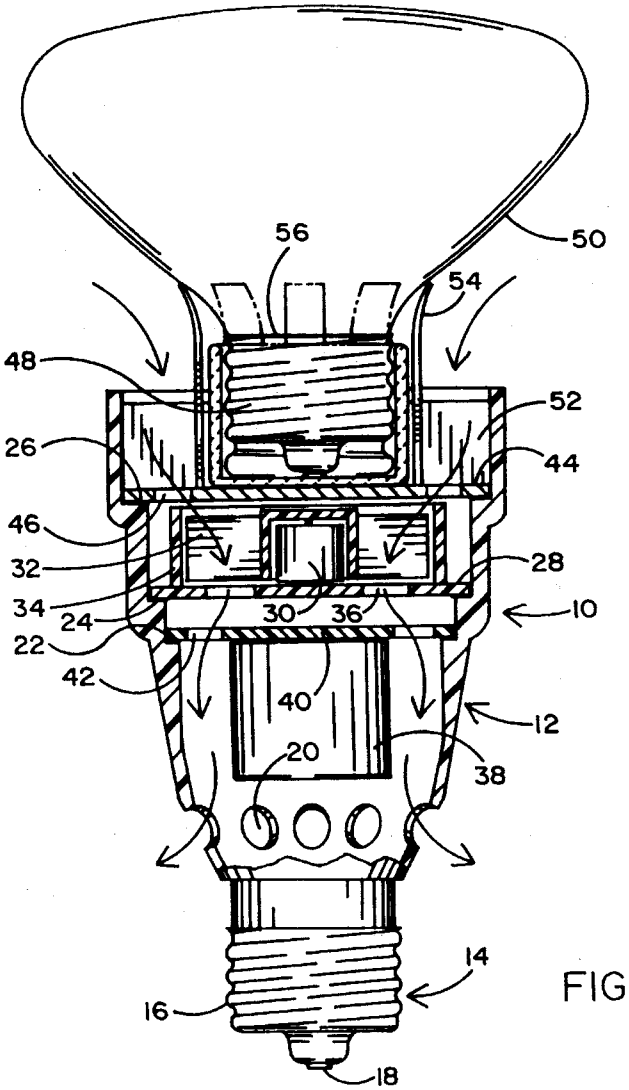
FIG. 2 is a substantially center line section therethrough.
Figure 1:
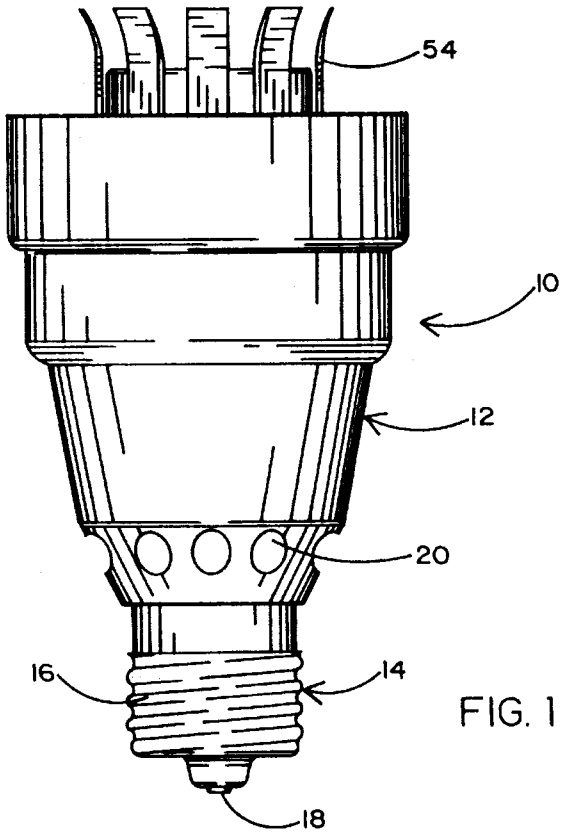
FIG. 1 is a side-elevational view of the first preferred embodiment of the lamp cooling system of this invention which utilizes a lamp bulb with a screw base.

The first preferred embodiment of the lamp cooling system of this invention is generally indicated at 10 in FIGS. 1 and 2. The system comprises a housing 12 which carries a threaded plug 14 on its lower end. The threaded plug 14 is of standard dimensions to screw into a bulb socket. It has a metal threaded sheath 16 and a separate insulated nose 16 to make contact at the two electrical potentials in the socket.

Housing 12 is generally cylindrical and tubular. It has a series of ventilation openings 20 adjacent the plug 14. Interiorly of the housing, the housing is provided with a series of steps 22, 24 and 26. These steps are successively of larger diameter in the upward direction away from the plug 14 to permit assembly. The second step 24 carries fan support board 28. Motor 30 is mounted in the center of the fan support board. Fan blades 32 are supported by the motor, are wrapped around the motor, and rotate with the motor. Shroud 34 surrounds blades to increase air delivery efficiency. Fan support board 28 is provided with air flow holes 36 to permit the fan to blow air, preferably downward, toward the threaded plug 14.

It is contemplated that the threaded plug be screwed into a socket which is supplied with 120 volt AC electric power. It is difficult to manufacture a motor 30 sufficiently small for such an application when it is to be powered by 120 volt AC. Accordingly, the motor 30 is of lower voltage and may be a direct current motor. Therefore, motor power supply 38 is provided. The power supply may be a transformer plus a diode bridge plus a condenser to provide a 12 volt DC output for the fan motor. Then the motor power supply is mounted on power supply board 40, which rests upon step 22. Holes 42 around the power supply permit air flow downward through the housing. The fan support board 28 and power supply board 40 may be dielectric and are secured in place by a convenient means such as molded-in resilient stops above the boards or by adhesive attachment. The output of the power supply 38 is connected to fan motor 30.

The top step 28 supports heat sink platform 44. The heat sink platform also has holes 46 therethrough to permit downward flow of air. The heat sink platform carries a socket 48 into which screws lamp bulb 50, in conventional manner. The lamp bulb has a standard threaded plug the same size as plug 14. The socket is firmly mounted on the heat sink plate 44 so that heat is conducted from the plug of the lamp bulb to the socket 40 and thence to the heat sink platform 44. The heat sink platform is made of metal such as aluminum and carries metal fins 52 which extend upward from the platform, as seen in FIG. 2. In addition, surrounding the socket 48, metal fingers 54 extend upward. These fingers are resilient and engage to the collar 56 on the bulb envelope. Quite often, the standard PAR light bulbs have such a collar thereon. When no such collar is present, the fingers 56 can engage on the neck of the bulb envelope above the base. Fingers 58 are also mounted on the heat sink.

Electrical connections from the threaded plug 14 directly connect to the socket 48 so that, when the plug is energized, the socket is energized. In addition, the motor power supply 38 is also energized from that source. As a result, when a lamp bulb is screwed into the socket 48 and the plug 14 is screwed into a source of electric power suitable for the lamp bulb, the system is energized. The lamp bulb is illuminated and the motor is energized. Air is drawn past the lamp bulb, across the fins 52 and through the holes 46 in the heat sink platform 44. The energized fan blades then blow the air across the motor power supply 38 and out through the vent openings 20 in the bottom of the housing. In this way, the lamp bulb runs cooler and, thus, has a longer life. Alternatively, a larger lamp bulb can be installed and still operate within reasonable life design parameters. The system 10 is thus suitable for utilization of standard lamp bulbs, including lamp bulbs with built-in reflectors.

Figure 4:
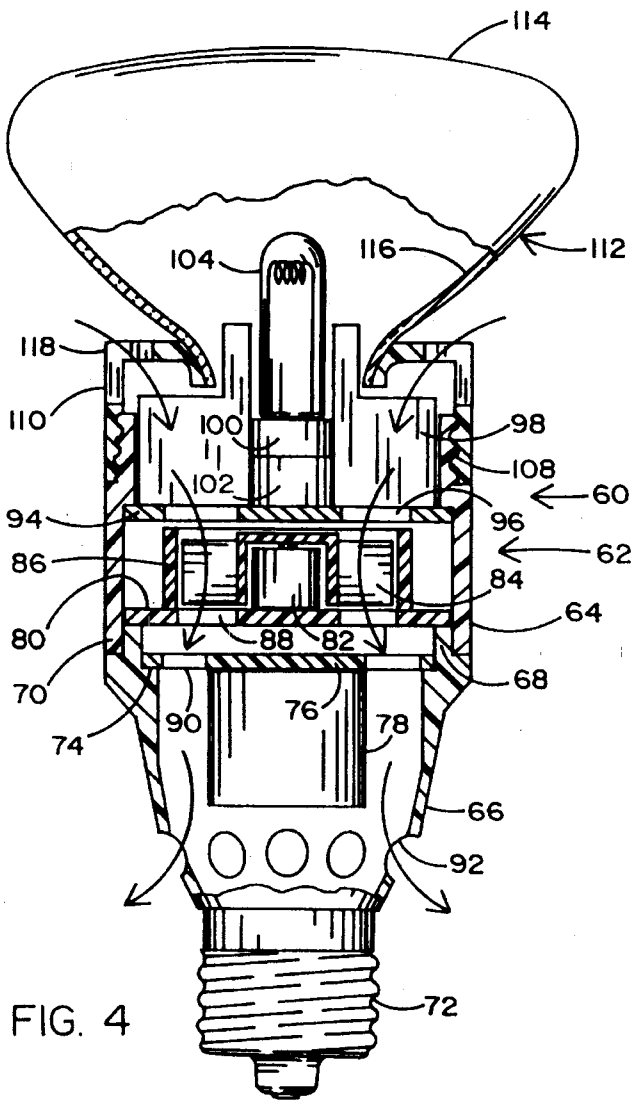
FIG. 4 is a substantially center line section therethrough.
Figure 3:
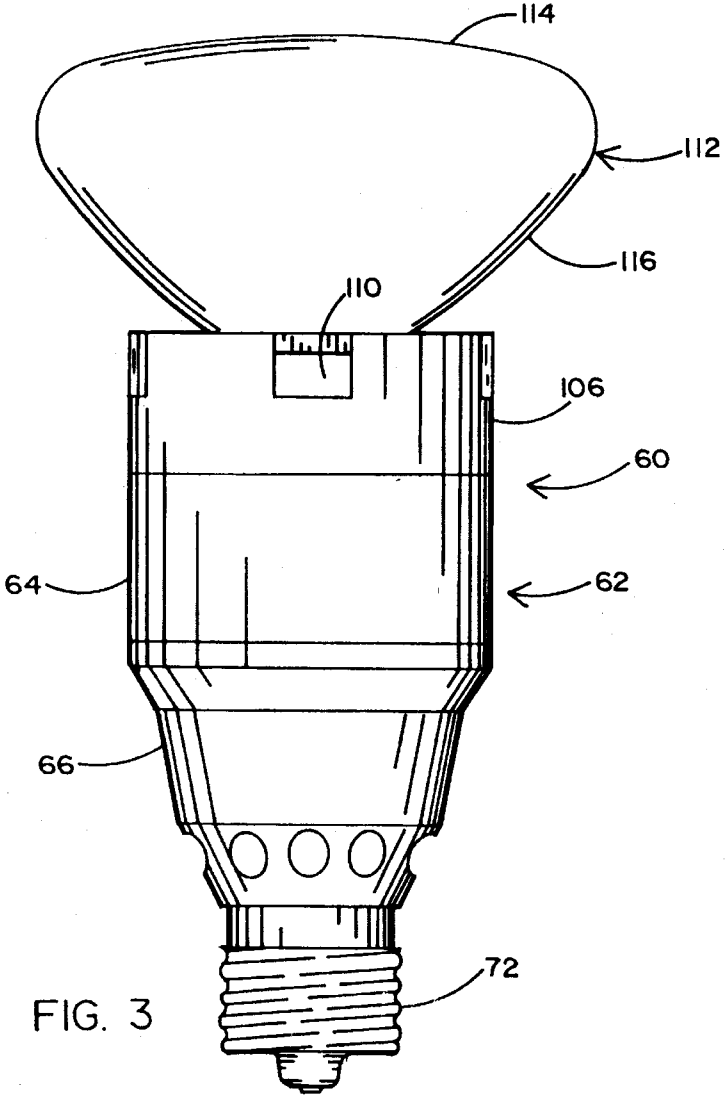
FIG. 3 is a side-elevational view of a second preferred embodiment of a lamp cooling system in accordance with this invention which utilizes a plug-in lamp.

The lamp cooling system 60, shown in FIGS. 3 and 4, is similar to the lamp cooling system 10. However, it is configured to permit the utilization of a lamp bulb which does not incorporate its own reflector. Instead, the reflector is mounted on the housing. Housing 62 is formed in upper and lower housing portions 64 and 66 for purposes of assembly. The two housing portions are joined at a sleeve joint where the upper housing portion enters around the outside of tube 68 and engages against the stop face 70 adjacent tube 68. The lower end of the housing has a standard threaded plug 72 thereon for threaded engagement in a standard socket and electrical engagement therein. Shoulder 74 is formed interiorly of the lower housing portion 66, and printed wiring board 76 engages thereagainst. The printed wiring board carries suitable circuitry and discrete components for providing the conversion necessary for output voltage, frequency and current. The circuitry mounted on printed wiring board 76 is generally indicated at 78 and may include a transformer or other type of converter oscillator to generate a low voltage AC high current, together with rectifiers preferably arranged in a bridge circuit and condensers to smooth the output of the rectifiers to supply the necessary DC voltage for the fan.

Mounted against tube 68 is fan support board 80. Fan motor 82 is mounted on the fan support board, and fan blades 84 are mounted around the fan. Fan shroud 86 surrounds the fan blades and is mounted on the fan support board 80 to enhance fan efficiency. Openings 88 in the fan support board, openings 90 in printed wiring board 76, and openings 92 in the lower housing portion permit air to be driven by the fan downward over the electronics and power converter on the board 76.

Heat sink baseplate 94 has openings 96 therein and has fins 98 thereon. The heat sink baseplate and its fins are preferably made in one piece of low thermal resistance metal such as aluminum or are connected with low thermal resistance therebetween so that heat is readily transferred. The configuration of the fins is generally radial from the upright center line of the baseplate so that the fan draws air downward across the fins, as indicated by the arrows in FIG. 4. It should be noted that the fins 98 extend upward along a portion of the bulb length, but not as far as the filament in the top of the bulb. A portion of the fins extends up into the lower portion of the lamp cover around the lamp bulb.

Lamp bulb socket 100 is directly mounted on a heat sink post 102, which forms an integral part of or is directly attached to the heat sink baseplate. The radial fins are preferably also attached to the heat sink post below socket 100.

In the present preferred embodiment, the lamp bulb 104 mounted in the socket 100 is a halogen lamp. Such halogen lamps require 12 volts AC, and this is also supplied from the power converter 78. Appropriate connections are made from the power converter to the lamp socket 100 and, when rectified, to the fan motor.

Collar 106 is screw-threaded onto the top of housing 62 on screw threads 108. The collar has ventilation openings 110 therein to permit a continuous air opening through the housing, including past the fins, through the fan and support boards and out of the housing. Collar 106 carries lamp cover 112, which has a front substantially transparent lens 114 and a reflector surface 116 around the lamp bulb 104. The reflector surface 116 is preferably configured so that the lamp bulb is at a focus so that substantially parallel light rays are delivered toward the lens 114. While a parabolic reflector together with a forward lens is shown as the preferred embodiment, the configuration of the lamp cover 112 can be as desired. For example, it may be globular or may have a decorative configuration. Furthermore, the lamp cover can be frosted, partly frosted, or partly reflectorized depending upon the application and the manner in which illumination is desired. The configuration of the lamp cooling system permits a halogen lamp to be force-cooled and powered in an ordinary socket.

This invention has been described in its presently contemplated best embodiments, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A lamp cooling system comprising:

a housing, said housing having a plug thereon for connection to an electric power supply;

a receptacle on said housing, said receptacle being sized to support and electrically connect an electric light bulb having first electrical characteristics;

an electric motor having second electrical characteristics and a fan connected to be driven by said electric motor, said electric motor and said fan both being within said housing, said fan being positioned so that it causes air to cool said receptacle; and means in said housing connected to said plug, said receptacle and said motor for receiving electric power from said plug and delivering electric power of first electrical characteristics to said receptacle and deliver electric power of second and different electrical characteristics to said motor.

2. A lamp cooling system comprising:

a housing, said housing having a plug thereon for connection to an electric power supply;

a receptacle on said housing, said receptacle being sized to support and electrically connect an electric light bulb;

a heat sink in said housing, said heat sink being thermally connected to said receptacle, said heat sink having fins thereon for heat dissipation;

an electric motor and a fan connected to be driven by said electric motor, said electric motor and said fan both being within said housing, said fan being positioned so that it causes air to move across said fins of said heat sink to cool said heat sink and said receptacle; and an electric power converter within said housing, said electric power converter being connected to said plug and to said motor for supplying electric power to said fan motor, said electronic converter being positioned to be cooled by air moved by said fan.

3. The lamp cooling system of claim 2 wherein said converter supplies direct current to said fan motor.

4. The lamp cooling system of claim 2 wherein there is a fan step within said housing and there is a fan support board mounted on said fan step, said motor being mounted on said fan support board, said fan support board having at least one opening therethrough to permit air delivered by said fan to pass through said fan support board.

5. The lamp cooling system of claim 2 wherein said heat sink has metal fingers thereon extending adjacent said receptacle, said metal fingers being positioned to engage upon a light bulb engaged in said receptacle.

6. The lamp cooling system of claim 2 wherein there is a heat sink step within said housing and said heat sink has a platform and said heat sink platform rests on said heat sink step, said heat sink platform having at least one opening therethrough so that air moved by said fan moves through said heat sink platform.

7. The lamp cooling system of claim 6 wherein there is a fan step within said housing and there is a fan support board mounted on said fan step, said motor being mounted on said fan support board, said fan support board having at least one opening therethrough to permit air delivered by said fan to pass through said fan support board.

8. The lamp cooling system of claim 7 wherein said plug is a screw-threaded plug and said receptacle is a screw-threaded receptacle.

9. The lamp cooling system of claim 6 wherein said heat sink has metal fingers thereon extending adjacent said receptacle, said metal fingers being positioned to engage upon a light bulb engaged in said receptacle.

10. A lamp cooling system comprising:

a housing, said housing having a plug thereon and having a receptacle therein, said plug being sized and positioned to be connected to an electric power supply, said receptacle in said housing being sized to receive and power a lamp bulb of first electrical characteristics;

an electric motor of second and different electrical characteristics, fan blades mechanically connected to said electric motor to be actuated when said electric motor is energized, both said motor and said fan blades being within said housing, said fan blades being positioned to move air past said receptacle within said housing to cool said receptacle within said housing; and means in said housing connected to said plug, to said motor and to said receptacle for receiving electric power from said plug and delivering electric power of first characteristics to said lamp receptacle and electric power of second and different electrical characteristics to said fan motor.

11. The lamp cooling system of claim 10 wherein there is a fan support board in said housing, said electric motor being mounted on said fan support board, said fan support board having openings therethrough to permit flow of air therepast.

12. The lamp cooling system of claim 10 wherein there is a heat sink plate in said housing, said heat sink plate being in thermal communication with said receptacle in said housing, fins on said heat sink plate adjacent said receptacle, said fins being within said housing and wherein said heat sink plate engages on a shoulder within said housing to position said heat sink plate and said fins in said housing.

13. The lamp cooling system of claim 12 wherein there is a fan support board in said housing, said electric motor being mounted on said fan support board, said fan support board having openings therethrough to permit flow of air therepast.

14. The lamp cooling system of claim 13 wherein there is a shoulder in said housing and said fan support board rests on said shoulder.

15. A lamp cooling system comprising:

a housing, said housing having a plug thereon and having a receptacle therein, said plug being sized and positioned to be connected to an electric power supply, said receptacle in said housing being sized to receive and power a lamp bulb;

a heat sink in said housing, said heat sink being in thermal communication with said receptacle in said housing, fins on said heat sink plate adjacent said receptacle, said fins being within said housing;

an electric motor, fan blades mechanically connected to said electric motor to be actuated when said electric motor is energized, both said motor and said fan blades being within said housing, said fan blades being positioned to move air across said fins and past said receptacle within said housing to cool said receptacle within said housing; and a power converter in said housing, said power converter being connected to said plug to be energized by said plug, said power converter being connected to said motor to supply power thereto.

16. The lamp cooling system of claim 15 wherein said power converter is mounted on a board and said board engages on a shoulder in said housing, said board having openings therethrough so that air moved by said fan passes through said converter support board and past said power converter to cool said power converter.

17. The lamp cooling system of claim 15 wherein said heat sink plate engages on a shoulder within said housing to position said heat sink plate and said fins in said housing.

18. The lamp cooling system of claim 17 wherein there is a fan support board in said housing, said electric motor being mounted on said fan support board, said fan support board having openings therethrough to permit flow of air therepast.

19. The lamp cooling system of claim 15 wherein said lamp receptacle in said housing is sized to receive a halogen lamp and said power converter is connected to supply power to said lamp receptacle.

20. The lamp cooling system of claim 19 wherein said cooling fins extend adjacent said lamp receptacle and adjacent a halogen lamp inserted in said lamp receptacle.

21. The lamp cooling system of claim 20 wherein said housing has threads thereon and a lamp cover has a base thereon, said base being in threaded engagement with said housing to position and retain said lamp cover over a lamp bulb in said lamp receptacle.

22. The lamp cooling system of claim 21 wherein said lamp cover base has openings therein so that air moved by said fan passes through said lamp cover base.

23. The lamp cooling system of claim 10 wherein said housing has threads thereon and a lamp cover has a base thereon, said base being in threaded engagement with said housing to position and retain said lamp cover over a lamp bulb in said lamp receptacle.

24. The lamp cooling system of claim 23 wherein said lamp cover base has openings therein so that air moved by said fan passes through said lamp cover base.

* * * * *